United States Patent [19]

Hynes et al.

[11] Patent Number: 4,554,976

[45] Date of Patent: Nov. 26, 1985

[54] TEST TOOL FOR SUBSEA BLOWOUT PREVENTER STACK

[75] Inventors: Joseph H. Hynes, Houston; Charles D. Morrill, Humble; George D. Hall, Bellaire, all of Tex.

[73] Assignee: Hydril Company, Los Angeles, Calif.

[21] Appl. No.: 494,038

[22] Filed: May 12, 1983

[51] Int. Cl.[4] ..... E21B 23/00

[52] U.S. Cl. ..... 166/341; 166/77.5; 166/85; 166/337; 285/39; 73/40.5 R; 73/46

[58] Field of Search ..... 166/341, 337, 339, 387, 166/380, 85, 77, 77.5, 124, 181, 250, 242, 381, 336, 351, 344, 378; 285/18, 39, 317, 333; 73/40.5 R, 46

[56] References Cited

U.S. PATENT DOCUMENTS

| | | | |
|---|---|---|---|
| 3,093,996 | 6/1963 | Jones | 73/40.5 R |
| 3,097,001 | 7/1963 | Le Bus | 285/361 |
| 3,136,367 | 6/1964 | Wright et al. | 166/124 |
| 3,177,703 | 4/1965 | Waters et al. | 166/337 |
| 3,248,129 | 4/1966 | Brown | 285/18 |
| 3,721,292 | 3/1973 | Ahlstone | 285/18 |
| 3,872,713 | 3/1975 | Ilfrey et al. | 73/40.5 R |
| 3,897,824 | 8/1975 | Fisher | 166/188 |

*Primary Examiner*—Stephen J. Novosad

*Assistant Examiner*—Hoang C. Dang

*Attorney, Agent, or Firm*—Dodge, Bush & Moseley

[57] ABSTRACT

A test tool adapted for use during pressure testing of a subsea blowout preventer stack is disclosed. The tool has an upper and a lower body connected in a first connection by left hand threads. A check valve landed in the bore of the tool prevents downward fluid flow from the interior of the tool, but allows upward flow through the tool and the attached drill pipe for the detection of leakage of the wellhead sealing tool about the wellhead during pressure testing of a blowout preventer in the stack. During testing of a shear ram blowout preventer, the upper body is disconnected from the lower body by turning the drill pipe to the right. Raising the drill pipe then causes the upper body to shift a second set of right hand threads into position and moves the upper body and the drill pipe from the bore of the shear ram allowing it to be closed for pressure testing. The lower body and a connected wellhead sealing tool may be retrieved without tripping the drill string by lowering the upper body for reconnection to the lower body by the right hand threads of the upper body engaging a second set of right hand threads on the lower body. After reconnection, drain ports are open in the tool allowing the drill pipe to be raised while draining drilling fluid from its interior.

26 Claims, 13 Drawing Figures

FIG. 11
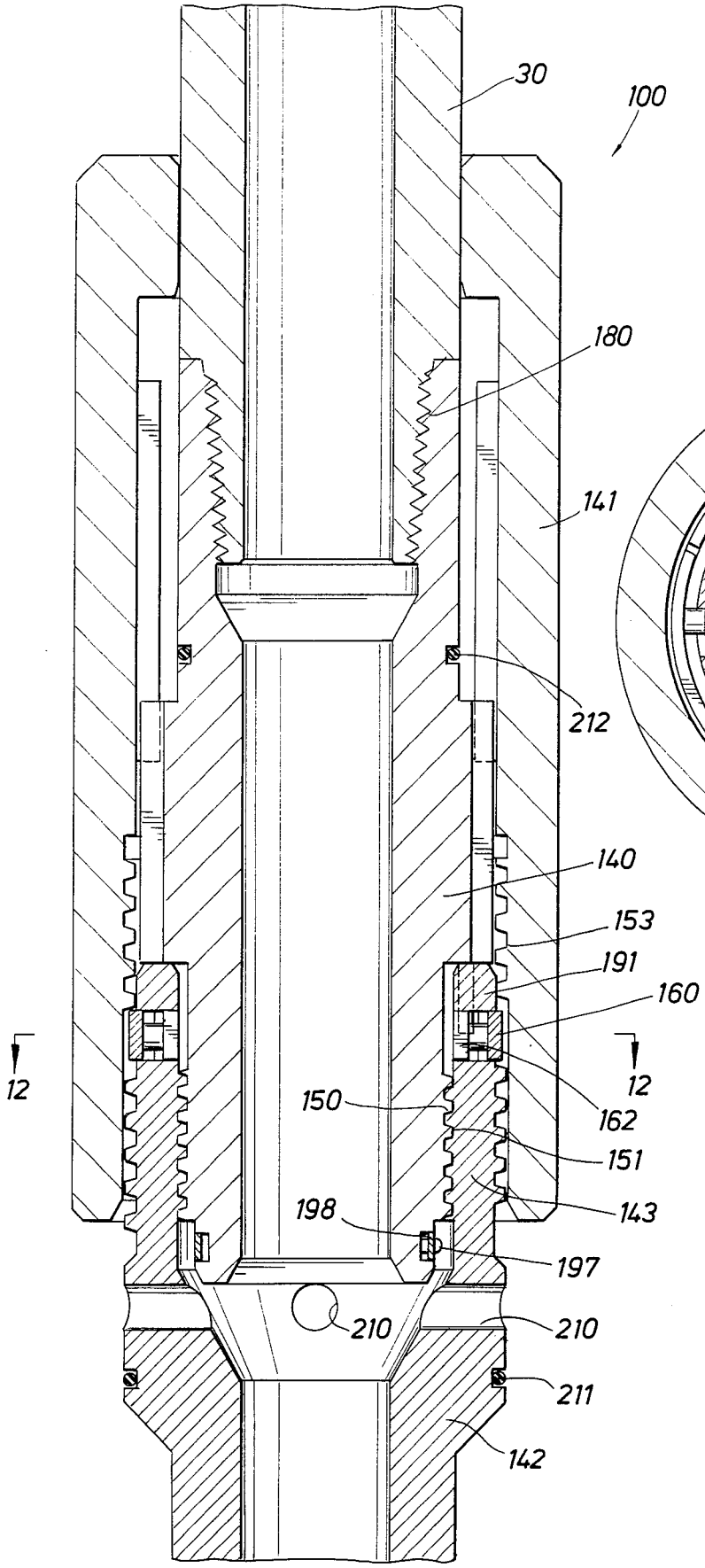
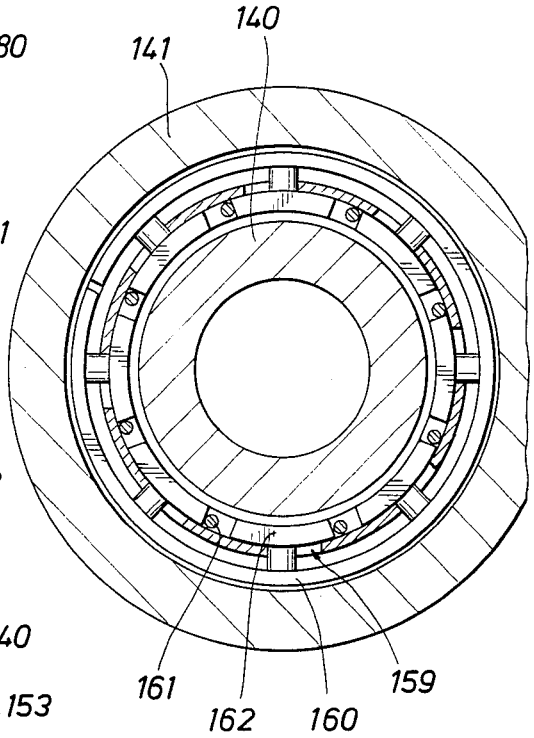
FIG. 12

TEST TOOL FOR SUBSEA BLOWOUT PREVENTER STACK

BACKGROUND OF THE INVENTION

1. Field of the Invention

This invention relates in general to apparatus which may be disconnected and reconnected in a wellbore by means of uni-directional angular manipulations of drill pipe without removing the drill pipe from the well. In particular, the invention relates to apparatus for testing blowout preventors in a subsea blowout preventer stack. Still more particularly, the invention relates to a tool facilitating testing of a shear ram blowout preventer in a subsea blowout preventer stack.

2. Description of the Prior Art

Blowout preventer stacks are used on the sea floor for controlling a well during floating drilling rig operations. The blowout preventer stack is attached to a wellhead on the ocean floor from which well casing is hung and cemented into the well bore. Attached to the top of the blowout preventer stack is a riser system extending to a floating drilling vessel such as a semi-submersible drilling platform or a drilling ship.

The individual blowout preventers are in general required to be tested by regulatory authorities in the interest of safety and ecology. Such tests have been conducted in the past by lowering a test tool from the drilling rig through the riser and through the open bores of the individual blowout preventers in the stack for sealing in the wellhead below the blowout preventer stack. The individual blowout preventers, with the exception of the shear ram, have been tested by pressuring the stack through the means of a choke or kill line with pressurized drilling fluid. Each individual blowout preventer is tested in turn by closing the preventer about the drill pipe and determining whether or not the preventer maintains the pressure from below. In the past the shear ram preventer in the stack has simply not been tested (because its shearing blades would shear the drill pipe) or has been tested to a low pressure against a cement plug in the casing while drill pipe was removed from the well bore.

With increasing interest in countries demanding the utmost in safety of its offshore waters, some governments have begun demanding that all elements in the blowout preventer stack be tested periodicly to full rated working pressure. Such a requirement has demanded that the shear ram blowout preventer also be tested.

A prior method and apparatus for testing the blowout preventers, including the shear ram blowout preventer, has been used. Such an apparatus has included a sealing test tool which is lowered by means of a drill pipe through the aligned bores of the individual blowout preventers of the subsea blowout preventer stack until it is landed in the wellhead. Such a sealing test tool has included a bore therein for communication with the interior of the drill pipe. The bore had been prepared for insertion of a check valve adapted to prevent downward fluid flow yet allowing flow to the interior of the drill pipe from beneath the sealing test tool in the wellhead. Such a check valve has enabled operators to check the efficiency of the sealing tool in sealing about the wellhead. When the stack is pressured by means of a choke or kill line, leakage below the sealing test tool could be detected in the interior of the drill pipe at the surface because of flow upwardly through the check valve.

Also included in the apparatus has been a backout sub connected between the sealing test tool and the drill pipe which may be disconnected, leaving the sealing test tool in the wellhead yet allowing the drill pipe to be raised above the shear ram blowout preventer for its testing. Such a backout sub has been provided with left hand threads connecting an upper part of the sub with a lower part such that the drill pipe may be disconnected from the lower part of the backout sub and the attached sealing test tool in the wellhead by turning the drill pipe to the right, thereby disconnecting the drill pipe and the upper part of the sub from the lower part of the sub. In order to reconnect the upper part of the sub and the drill pipe with the lower part of the sub, it has in the past been necessary to "trip" the drill pipe. That is, the drill pipe is raised joint by joint to the surface, such that a connector with right hand threads may be provided on the upper part of the sub. When the drill pipe is lowered (again, joint by joint) back down through the riser and through the blowout preventer stack, it was then possible to reconnect the upper part of the sub to a second set of right hand threads on the lower part of the sub. A right hand turning of the drill pipe could again connect the upper part of the sub with the lower part of the sub.

The industry has recognized the advantage of being able to disconnect from the lower part of the sub and reconnect to the lower part of the sub after the shear ram blowout preventer has been tested. A single set of left hand threads could be provided to connect the upper and lower parts of the sub. Such a connection would require disconnection by turning to the right and reconnection by turning to the left, a procedure which would eliminate the necessity of tripping the drill pipe. Turning only to the right to disconnect and then reconnect the upper part of the sub and the lower part of the sub obviates the possibility of disconnecting one of the joints of the drill pipe which are typically connected with right hand threads. As described above, apparatus used for testing a shear ram blowout preventer in a subsea blowout preventer stack requiring only right hand turning for disconnection and reconnection has required the tripping of the driill pipe. In deep water, tripping of the drill pipe may cause considerable delay in the testing process, a process which must be accomplished periodicly during drilling. Drilling delays in offshore operations are very expensive.

Prior apparatus for testing subsea blowout preventer stacks has included a sliding sleeve ported sub connected in the drill pipe string above the backout sub to allow the tool string bore to drain during retrieval after testing so that the pipe is not raised to the surface with drilling fluid trapped in its interior.

It is thus an object of the invention to provide a tool having the means to disconnect and reconnect a sealing test tool in a wellhead below a subsea blowout preventer stack by turning a drill pipe connected to the upper part of the tool in a single direction without tripping the drill pipe.

It is a further object of the invention to provide a tool useful in testing a shear ram blowout preventer in a subsea blowout preventer stack in which drill pipe is turned to the right to disconnect a top portion of the tool which is then raised above the blind ram to be tested and then lowered for reconnection with the lower portion of the tool by again turning the drill pipe to the right without the necessity of tripping the drill pipe to the surface of the drilling rig.

It is another object of the invention to provide drain ports in the tool such that when the tool is retrieved to the surface, the drain ports are open to the exterior of the tool thereby assuring that drilling fluid is not trapped in the interior of the drill pipe as it is being raised to the surface.

It is a further object of the invention to provide a bore in the tool in which a check valve may be inserted allowing upward flow through the bore of the tool and the drill pipe if pressurized fluid were to leak past the sealing test tool so that it can be detected at the surface.

SUMMARY OF THE INVENTION

In its most general aspect, the invention relates to apparatus for disconnecting and reconnecting two parts of a tool in a well requiring only a single direction of turning by an attached drill pipe. The tool includes an upper body means having thread means at its top end for connection to the drill pipe and having first and second threaded surfaces axially separated from each other at its lower end. The first threaded surface has male left hand threads whereas the second threaded surface has female right hand threads. The lower body means has third and fourth threaded surfaces with the third threaded surface having female left hand threads and the fourth threaded surface having male right hand threads. When the upper body means and lower body means are initially connected, the upper and lower body means are connected by left hand threading of the first threaded surface of the upper body means with the third threaded surface of the lower body means.

The first connection is disconnected by rotating a drill pipe connected to the upper body means to the right with respect to the lower body means. After disconnecting of the upper body means from the lower body means and shifting of the first and second threaded surfaces of the upper body means from a first position to a second position, a reconnection between the upper and lower body means is established by lowering the drill pipe until the upper and lower body members are engaged and by turning the drill pipe such that the upper body member is rotated to the right with respect to the lower body member. Rotation to the right causes the right hand second threaded surface of the upper body member to threadedly connect with the right hand fourth threaded surface of the lower body member. Thus, the apparatus according to the invention is disconnected and reconnected by turning the drill pipe in a single direction.

In the preferred embodiments of the invention when used for testing blowout preventers in a subsea blowout preventer stack, a wellhead sealing means is connected to the body of the lower body means. The wellhead sealing means is adapted to seal the annulus between the wellhead and the lower body means and has a bore therethrough for fluid communication with a bore of the lower body means.

The invention further includes a landing means in the bore of the lower body means for landing a check valve adapted to prevent fluid flow downward from the lower body means through the valve but to allow fluid flow upward from the bore of the connected wellhead sealing means to the lower body means. Such a check valve is advantageously provided as an aid in the determination of the quality of the seal of the wellhead sealing means to the wellhead. If such a seal is not good, pressurized fluid from a choke or kill line in testing a blowout preventer will leak below the seal into the interior of the well and then pass through the bore and through the drill pipe to the surface where a determination of leaking may be sensed.

The apparatus further includes means for closing drain ports to the bore of the apparatus when the upper body means and the lower body means are in the first connection and for opening the drain ports to the bore of the apparatus when the upper body means and lower body means are in the second connection. Thus the apparatus may be returned to the surface by means of drill pipe while allowing the interior of the drill pipe to drain assuring that the drill pipe is not raised "wet".

BRIEF DESCRIPTION OF THE DRAWINGS

The foregoing summary of the invention and other objects and advantages of the invention will be described in more detail below taken in conjunction with the accompanying drawings of which:

FIG. 11 illustrates the alternative embodiment of the part of the tool after the mandrel and sleeve have been relatively shifted and illustrating the second connection of the tool where the mandrel is threadedly engaged with the lower body means; and FIG. 12 illustrates a cross section through that part of the tool illustrated in FIG. 11 showing the alternative connecting means after axial shifting of the mandrel and sleeve has taken place.

DESCRIPTION OF THE INVENTION

Figure 1:
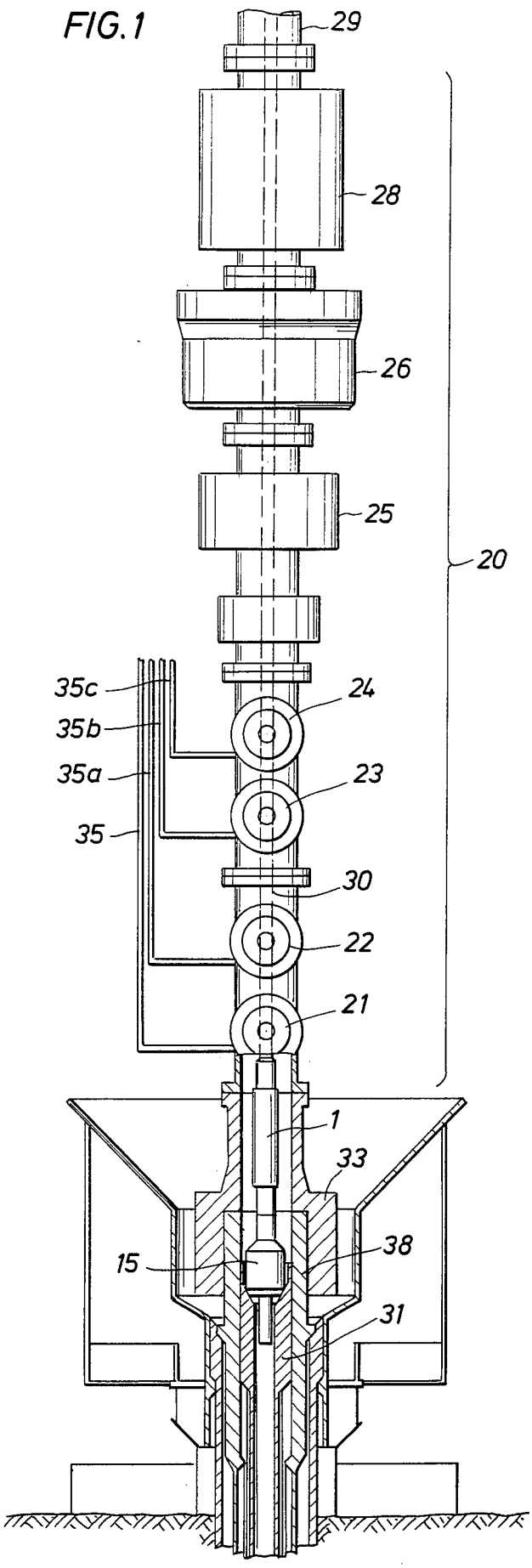
FIG. 1 illustrates in schematic form the environment in which the apparatus according to the invention is used, that is, in the testing of a subsea blowout preventer stack on the ocean floor which is used in drilling operations from a floating vessel.
Figure 6A:
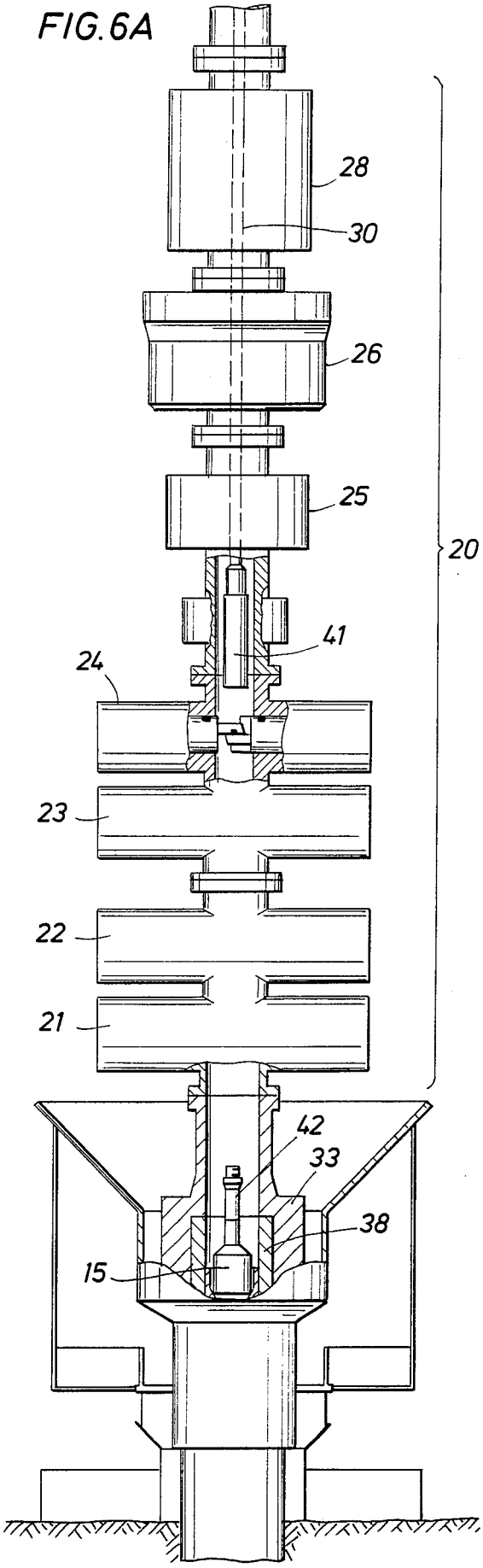
FIG. 6A illustrates the upper part of a tool according to the invention raised above the shear ram for pressure testing of the shear ram blowout preventer while the lower part of the tool with an attached wellhead sealing tool seals about the wellhead below.

FIG. 1 illustrates a subsea blowout preventer stack shown generally at 20 attached by means of a hydraulic connector 33 to a wellhead 38. Typical blowout preventer stacks include three pipe ram blowout preventers 21, 22 and 23 and a blind ram or shear ram blowout preventer 24. (FIG. 1 illustrates the stack 20 in a side view so that the choke or kill lines 35, 35a, 35b, 35c may be easily illustrated; FIG. 6A illustrates the stack 20 in a front view with illustration of the choke or kill lines omitted). Attached to the top of the ram-type blowout preventers 21, 22, 23 and 24 is an annular blowout preventer 26 attached by means of a hydraulic connector 25. A flex joint 28 is provided for connecting the stack 20 to a riser system 29 extending to a floating drilling vessel such as a semi-submersible drilling rig or a drill ship. A choke or kill line 35 is illustrated extending from the drilling rig to ram blowout preventer 21. Other choke or kill lines 35*a*, 35*b*, 35*c*, may be provided between the ram blowout preventers. A single choke or kill line 35 could be used for the pressure testing of the blowout preventers to provide pressurized drilling fluid into the bore of the blowout preventer stack.

According to the invention, a test tool 1 is provided on the end of drill pipe 30 which extends upwardly to the drilling platform (not shown). Attached to the bottom of the test tool 1 is a sealing tool 15 for sealing about wellhead 31. Two alternative embodiments according to the invention of the test tool 1 are described below. The first alternative embodiment is designated generally by the reference number 10 and is illustrated in FIGS. 2 through 8. The second alternative embodiment is designated generally by reference number 100 and is illustrated in FIGS. 9 through 12.

DESCRIPTION OF FIRST ALTERNATIVE EMBODIMENT OF TEST TOOL 1

Figure 2:
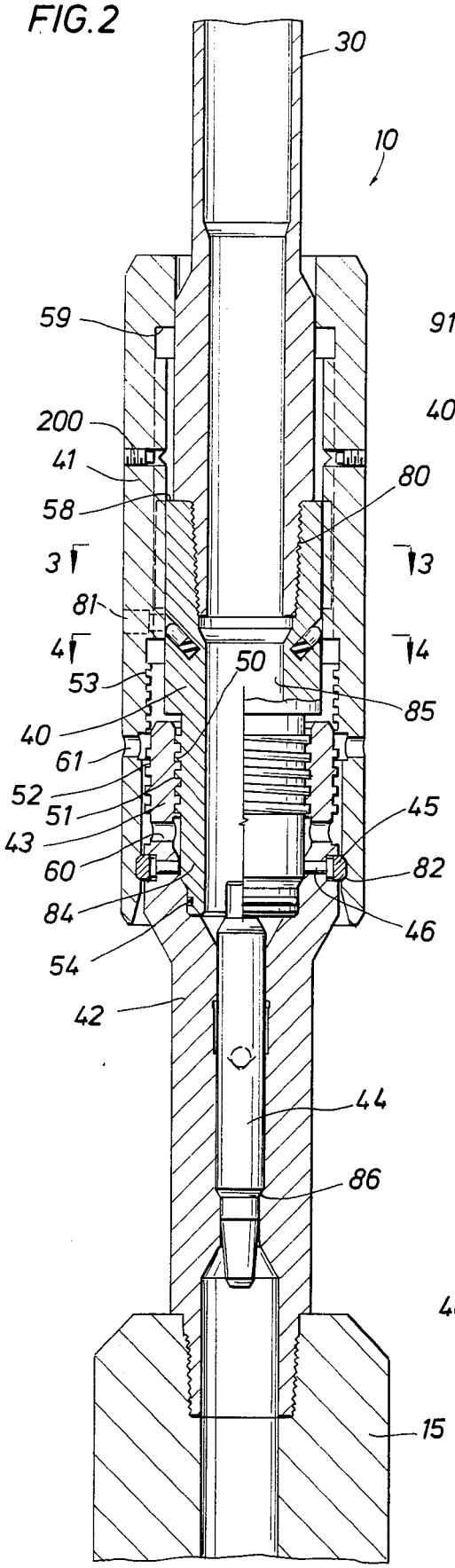
FIG. 2 shows a cross-section of a first embodiment of the test tool according to the invention illustrating the releasable connection between an upper part and a lower part of the tool and the connection of a wellhead sealing tool to the lower part.

FIG. 2 illustrates the first embodiment of the test tool 1 and referred to as test tool 10 with a wellhead sealing tool 15 threadedly attached to its bottom. The test tool 10 includes an upper part including mandrel 40 and outer sleeve 41 and a lower body 42. The mandrel 40 is attached to drill pipe 30 by threads 80. Mandrel 40 includes an axial bore in alignment with the bore of the drill pipe 30. Lower body 42 also has an axial bore for fluid communication through the aligned axial bores of lower body 42, mandrel 40 and drill pipe 30.

As illustrated in FIG. 2, the test tool 10 is connected for initially running into the subsea stack 20. The upper part of the tool and the lower part of the tool are connected by means of left hand male threads 50 on the male part of the mandrel 40 and the female left hand threads 51 on the box member 43 extending upwardly from the upper part of lower body 42. An outer sleeve 41 is secured to mandrel 40 when initially made up by means of set screws 81. After the upper part of the test tool is made up by left hand threading of the mandrel 40 to the female interior threads of box 43, outer sleeve 41 is secured to the lower body 42 by means of expansion ring 45 and pins 46. A plurality of pins 46 are disposed about the periphery of lower body 42 and force expansion ring 45 outwardly into slot 82 about the inner periphery of outer sleeve 41. As illustrated, the pins 46 engage the middle portion 84 of mandrel 40 when the mandrel 40 is connected to lower body 42 in the first connection illustrated in FIG. 2.

Also illustrated in FIG. 2 are male right hand threads 52 on the outer surface of box 43 and the female right hand threads 53 axially above the male left hand threads 50 on sleeve 41. FIG. 2 further illustrates a plurality of holes 60 extending about the periphery of the upper box 43 and the holes 61 extending about the periphery of the outer sleeve 41. In the connection illustrated in FIG. 2, the holes 61 in sleeve 41 and the holes 60 in the box 43 are axially separated. Sealing means such as "O" ring 54 prevents fluid communication from the interior bore 85 of the test tool 10 to the exterior of the tools via holes 60 or 61.

According to the invention, a check valve 44 is adapted for insertion into the test tool 10 through the bore 85 thereof and landing by means of landing shoulder 86 within the lower body 42.

Referring now to both FIGS. 1 and 2, when the tool 1 (in this first embodiment, the test tool 10) is lowered by means of drill pipe 30 below the blowout preventer stack 20, sealing tool 15 seals about the annulus of wellhead 31. The blowout preventers are pressure tested in turn by closing the blowout preventer on the drill pipe 30 and providing pressurized drilling fluid from choke or kill line 35 (or one of the lines 35*a*, 35*b*, 35*c*) into the bore of the preventers. The seal between the sealing tool 15 and the wellhead 31 may be tested in conjunction with the functioning of check valve 44. If the seal is faulty between the sealing tool 15 and the well head 31, pressurized drilling fluid will leak downwardly past the sealing tool 15 into the interior of the wellhead below the check valve 44. Pressurized fluid may then extend upwardly through check valve 44, through the bore 85 of the tool and into the bore of the drill pipe 30. Such pressure in the interior of the drill pipe may then be sensed at the drilling platform to indicate that the seal about the wellhead is not good.

Figure 3:
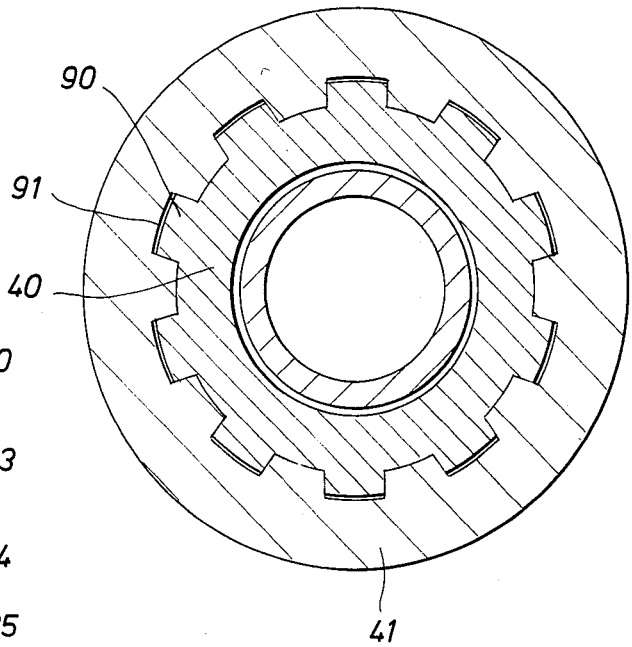
FIG. 3 shows a cross-section through the upper part of the apparatus of FIG. 2 illustrating a spline mechanism whereby a mandrel and outer sleeve of the upper part of the tool may be angularly rotated as a unit yet allowing the sleeve to move axially with respect to the mandrel.

Returning again to the details of the tool 10 as illustrated in FIG. 2, a downwardly facing shoulder 59 is provided at the upper part of outer sleeve 41 and an upwardly facing shoulder 58 is provided at the upper part of mandrel 40. As illustrated in FIG. 3, which is a cross-section through section 3—3 of FIG. 2, a plurality of splines 90 in the mandrel 40 are disposed in a plurality of slots 91 in outer sleeve 41. The splines and slots arrangement allows relative axial movement of mandrel 40 with respect to outer sleeve 41, yet causes the mandrel 40 and sleeve 41 to move angularly as a unit in response to the rotation of drill pipe 30. Thus, rotation to the right of drill pipe 30 causes disengagement of the threaded connection of left hand male threads 50 on the mandrel 40 and the left hand female threads 51 on the box 43.

Figure 5:
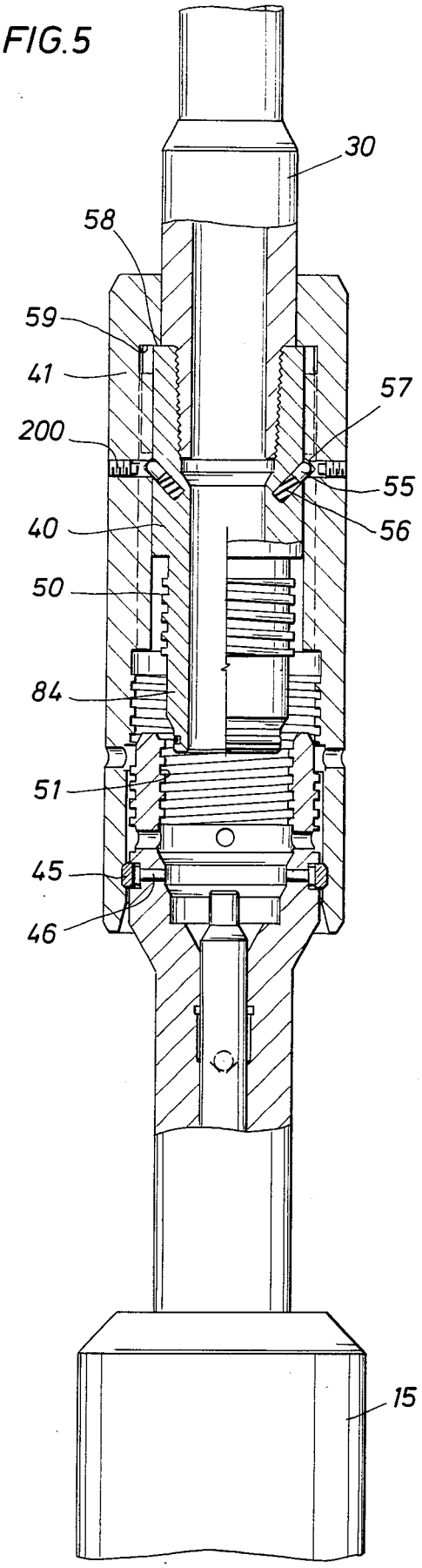
FIG. 5 illustrates the tool of FIG. 2 after the drill pipe has been rotated to the right and pulled upwardly until just before further pulling on the pipe will release the outer sleeve of the upper part of the tool from the lower part of the tool.

FIG. 5 illustrates the condition of the tool after the drill pipe has been rotated to the right and the male left hand threads 50 have been disengaged from the female left hand threads 51 and the upward force on drill pipe 30 has caused mandrel 40 to be shift axially up with respect to outer sleeve 41. As illustrated in FIG. 5, the upward facing shoulder 58 of mandrel 40 engages the downward facing shoulder 59 of sleeve 41. As illustrated, the retaining pins 46 are no longer supported by lower part 84 of mandrel 41, the pins 46 extending inwardly and no longer providing outward restoring force to retaining ring 45. Thus as the drill pipe 30 has an upward pulling force causing upwardly facing shoulder 58 to engage downwardly facing shoulder 59 of outer sleeve 41, outer sleeve 41 and mandrel 40 are pulled upwardly as a unit whereby the lower part of the outer sleeve slides easily past the retaining ring 45.

Figure 6:
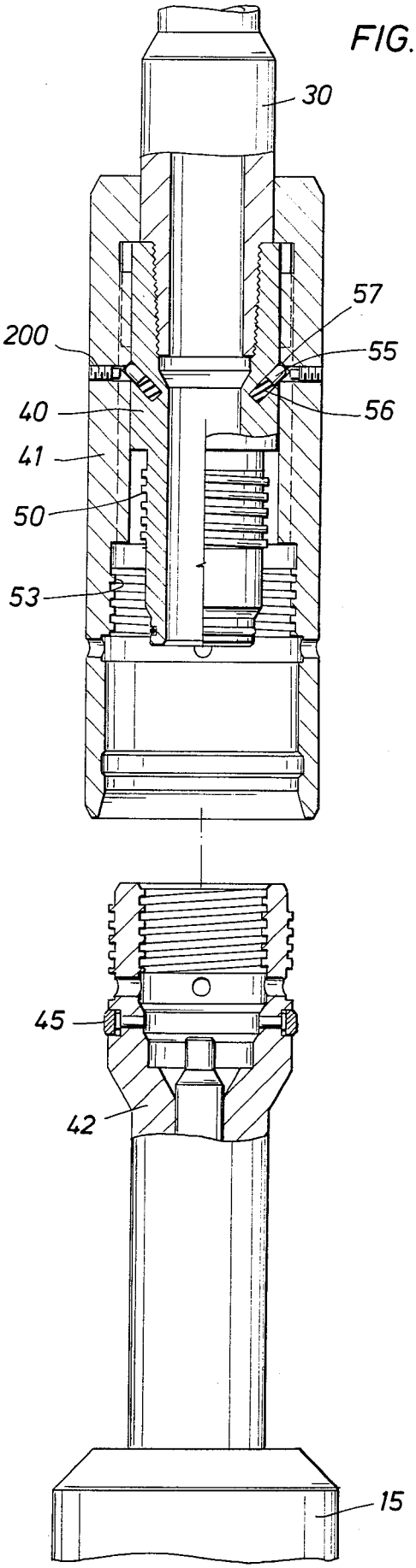
FIG. 6 illustrates the separation of the upper part of the tool of FIG. 2 from the lower part of the tool caused by further upward movement of the drill pipe on the upper part of the tool.

FIG. 6 illustrates the complete disengagement of the upper part of the tool from the lower part of the tool where the outer sleeve 41 has been completely disengaged from retaining ring 45. As illustrated in FIG. 6A, during testing of the blind shear ram 24, the drill pipe 30 is moved upwardly until the upper part (outer sleeve 41 is visible in FIG. 6) of the tool is above the blind shear ram. The lower part of the tool 42 remains at the wellhead and the attached sealing tool 15 remains sealing the wellhead such that a pressurized drilling fluid from choke or kill line 35 pressurizes the stack such that the blind shear ram 24 may be closed and tested for its ability to completely seal off the bore of the stack.

Figure 4:
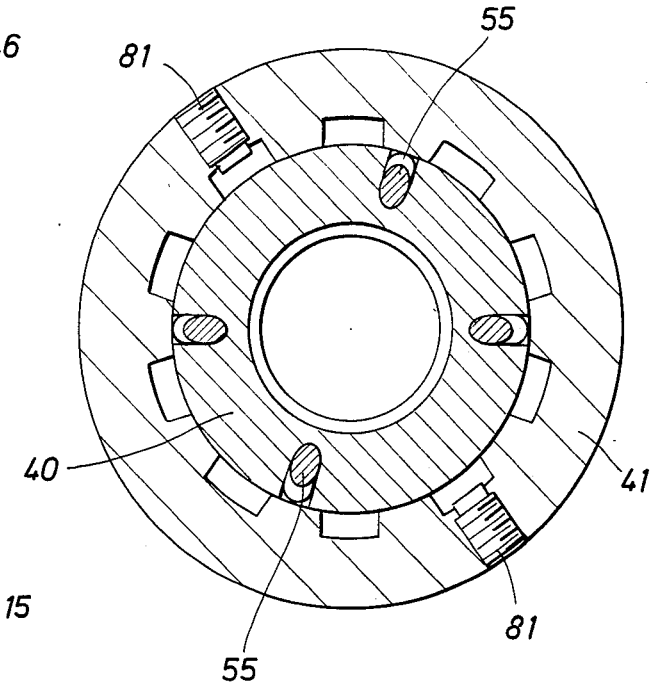
FIG. 4 shows another cross-section through the upper part of the tool of FIG. 2 illustrating locking pins disposed in the mandrel which prevent further relative axial movement between the sleeve and mandrel of the upper part of the tool after shifting of the mandrel with respect to the sleeve.

FIG. 6 illustrates the axial shifting of the threads on the mandrel and sleeve of the upper part of the tool. The male left hand threads 50 on mandrel 40 are now axially above the female right hand threads 53 in the outer sleeve. This axial separation of the threads on the mandrel and on the sleeve is to be contrasted with the condition shown in FIG. 2 where the male left hand threads 50 are axially below the female threads 53 on the outer sleeve. It should also be pointed out as illustrated in FIGS. 5 and 6 that the locking pins 55 have now been urged outwardly by springs 56 into recesses 57 preventing further axial movement between the mandrel 40 and the outer sleeve 41. FIG. 4 illustrates pins 55 in a cross-section through section 4—4 of FIG. 2.

Thus, in the condition of the tool in FIGS. 5 and 6 the mandrel 40 and outer sleeve 41 are locked together both axially and angularly, the axial locking being by means of locking pins 55 in recesses 57, the angular locking being by means of the spline and slot arrangements illustrated FIGS. 3 and 4. After testing of the blind ram, the upper part of the tool may be reconnected to the lower part of the tool as illustrated in FIG. 7.

Figure 7:
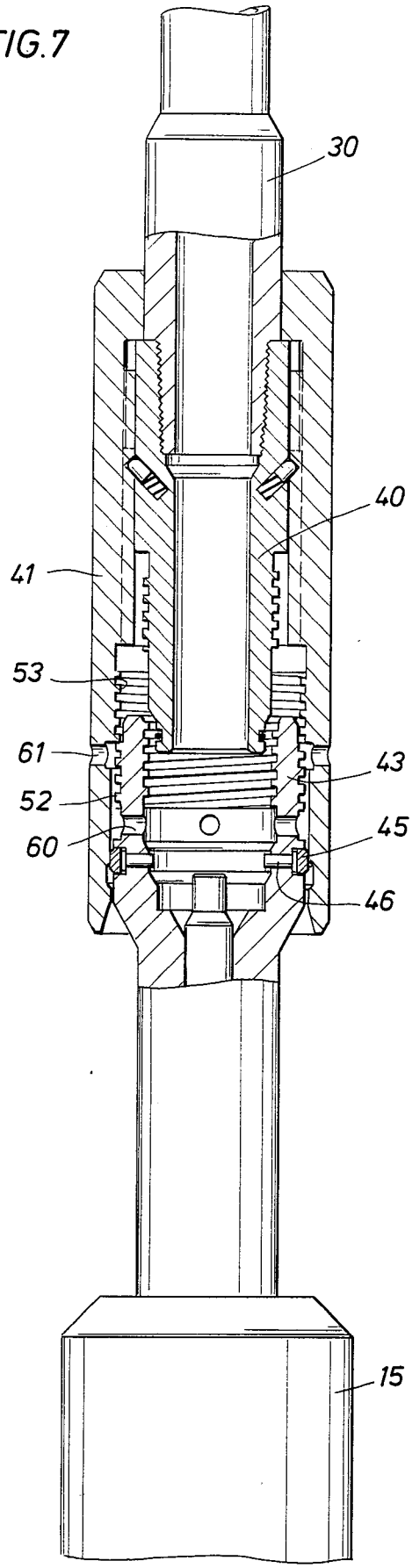
FIG. 7 illustrates the status of the tool of FIG. 2 in preparation for reconnection of the upper part of the tool with the lower part of the tool.

FIG. 7 illustrates the upper and lower parts of the tool where the upper part of the tool has been lowered to a point where the female right hand threads 53 on the outer mandrel 41 are beginning to engage the male right hand threads 52 on the box 43.

Figure 8:
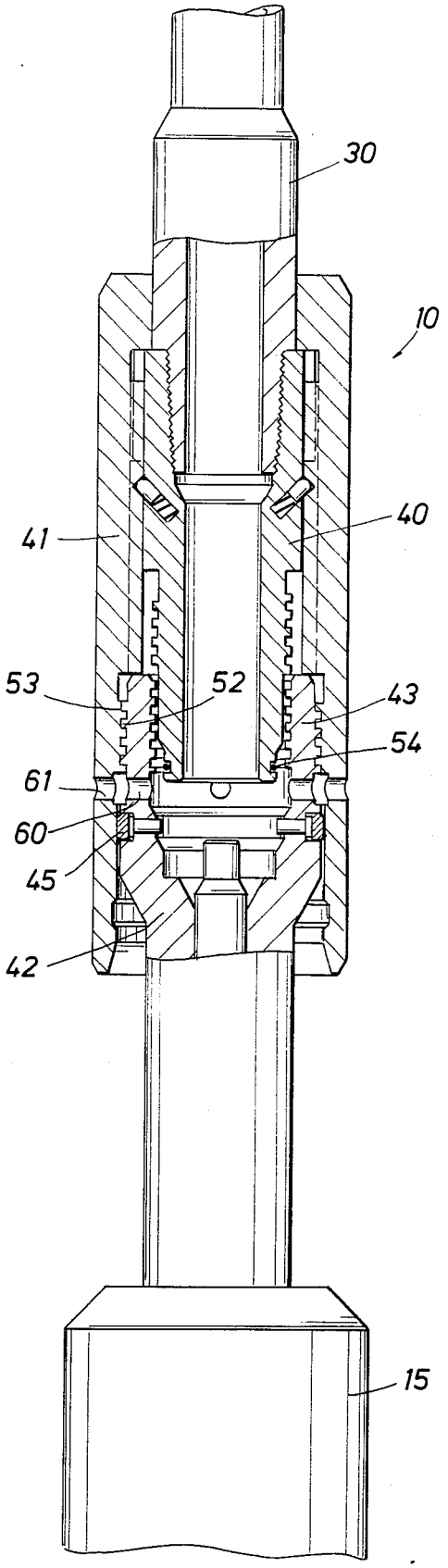
FIG. 8 illustrates the status of the tool of FIG. 2 after it has been reconnected by turning the drill pipe to the right.

As illustrated in FIGS. 7 and 8 when the upper body means is being reconnected to the lower body means, the retaining ring 45 no longer is effective in preventing axial movement of the sleeve 41 with respect to the lower body means 42 in that the retaining pins 46 are not forced outwardly by the mandrel 40. As the outer sleeve 41 moves downwardly during reconnection of the upper body means with the lower body means as illustrated in FIG. 7, the outer sleeve 41 slides past retaining ring 45. As illustrated in FIG. 8, retaining ring 45 merely urges against the outer sleeve 41 no longer functioning to prevent axial movement of sleeve 41.

FIG. 8 illustrates the condition of the tool after the right hand rotation of the drill pipe 30 where the female right hand threads 53 of sleeve 41 are threadedly engaged with the male right hand threads 52 of box 43 of lower body means 42. As illustrated, on complete make up in the second connection of the tool, the holes 61 in the outer sleeve member 41 are in axial alignment with holes 60 in box 43 of lower body means 42. Since the mandrel 40 is now axially shifted with respect to outer sleeve 41, the mandrel and its sealing member 54 no longer block the holes 60 in box member 43 and fluid communication exists between the interior of the tool and the exterior of the tool via the aligned holes 60 and 61 about the periphery of the tool. The entire tool 10 in its second connection and with its connected test sealing tool 15 may now be raised to the surface. Advantageously, any drilling fluid in the interior of the tool 10 or in the drill pipe 30 may be drained during raising of the pipe and the tool, eliminating the difficulty of raising a drill pipe full of drilling fluid.

To reset the tool, the locking pins 55 are depressed by reset screws 200 and the sleeve 41 shifted to the position shown in FIG. 2.

DESCRIPTION OF SECOND ALTERNATIVE EMBODIMENT OF TEST TOOL 1

Figure 9:
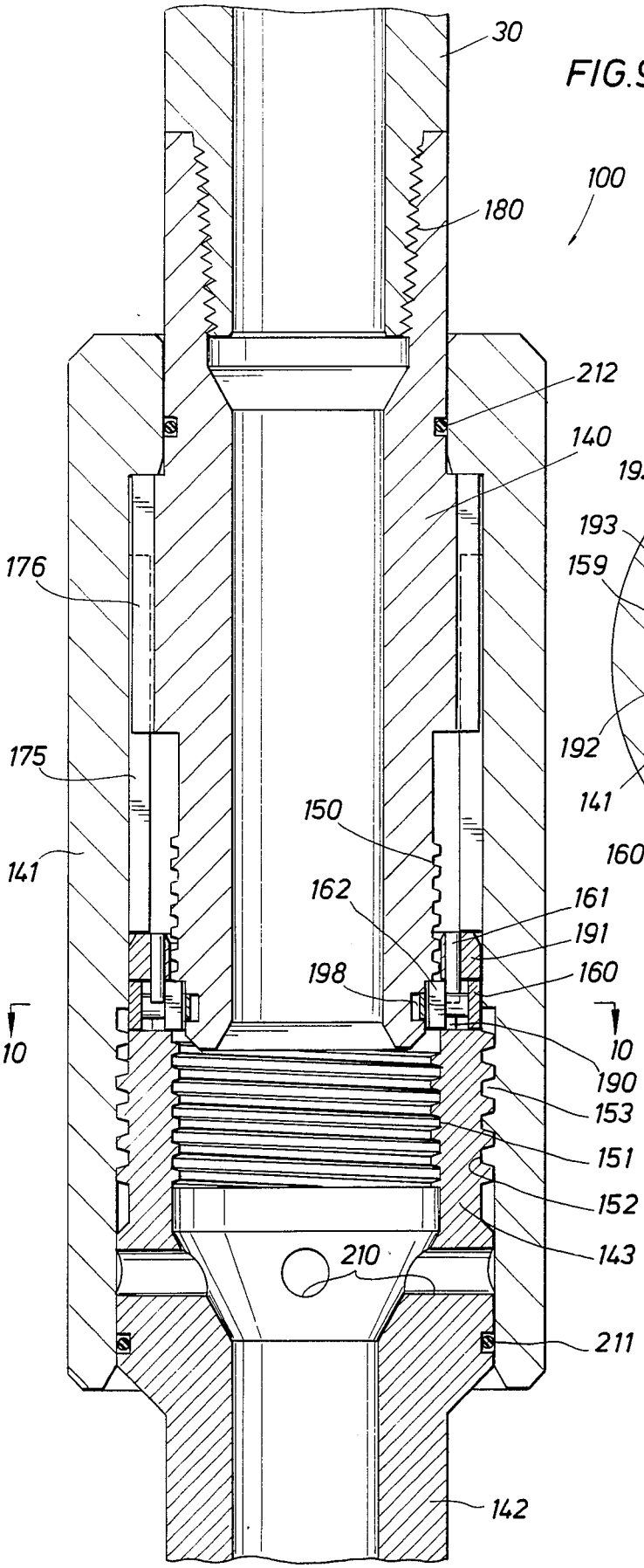
FIG. 9 illustrates an alternative embodiment of the part of the tool adapted for establishing a first connection between the upper and lower parts of the tool, for disconnecting the upper and lower parts by turning the drill pipe to the right and for reconnecting the upper and lower parts by again turning the drill pipe to the right.

FIG. 9 illustrates the second embodiment of the test tool 1 of FIG. 1 and is here referred to as test tool 100. Like the first embodiment, a sealing tool 15 may be threadedly attached to its lower body means 142. In the same manner, the upper part of the test tool 10 may be threadedly attached to a drill pipe 30 as by threads 180.

In this second alternative embodiment of the test tool, test tool 100 includes a lower body means 142 having an upper box member 143 having threads provided on its exterior and interior surfaces. In this embodiment 100 of test tool 1 of the invention, the threads on the exterior cylindrical surface of upper box 143 are left hand threads 152 while the threads 151 provided on the interior of the cylindrical surface of upper box 143 are right hand threads. The upper body means of the test tool 100 includes an outer sleeve member 141 and a mandrel 140.

The mandrel 140 and the outer sleeve 141 are adapted to be initially connected to each other in the manner illustrated in FIG. 9. The outer sleeve member 141 extends axially below the mandrel 140 whereby the left hand threads 153 of the interior surface of the outer sleeve member 141 are adapted for left hand threading and connection to the left hand threads 152 on the exterior cylindrical surface of the upper box 143. As illustrated in FIG. 9, exterior threads 150 about the exterior of the mandrel 140 are shifted axially above the threads 153 provided about the interior cylindrical surface of the outer sleeve 141.

Figure 10:
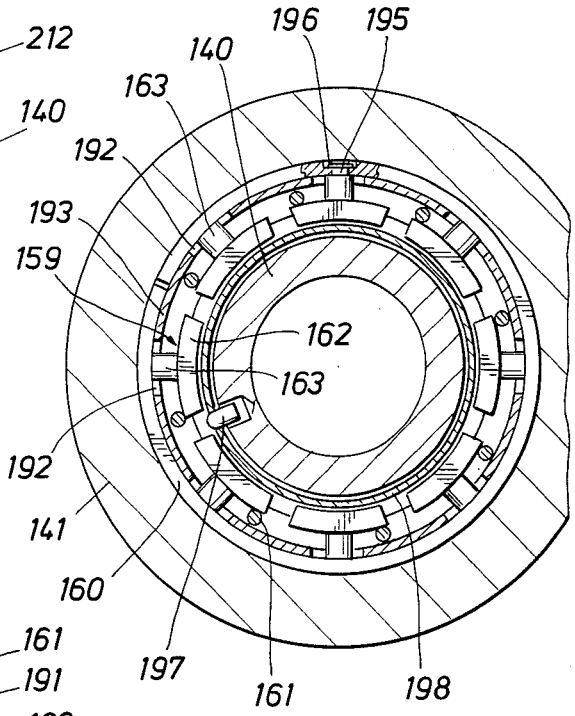
FIG. 10 illustrates a cross section of that part of the tool illustrated in FIG. 9 showing the alternative means for initially connecting the mandrel and outer sleeve of the upper part of the tool and illustrating an alternative means for axially shifting the mandrel and sleeve after disconnection of the initial connection of the upper part of the tool from the lower part of the tool.

FIG. 10 in conjunction with FIG. 9 illustrates the manner in which the mandrel 140 and the outer sleeve 141 are coupled together whereby the upper body means including the mandrel 140 and the outer sleeve 141 may be threadedly attached to the lower body means 142 by left hand threading of threads 153 of the sleeve with the left hand threads 152 of the box 143.

As illustrated in FIGS. 9 and 10, a shuttle ring comprising expansion ring 160 and a plurality of "T" shaped pins 159 are provided in annular groove 190 in an extension 191 extending upwardly from the upper box 143.

The pins shown generally at 159 have heads 162 and columns 163 which extend through slots 192 in a thin wall 193 connecting the box 143 and the extension 191. The foot 195 of each "T" shaped pin 159 is connected to the expansion ring 160 by means of a retainer ring 196. In the connection of the tool as illustrated in FIG. 9 and FIG. 10, the expansion ring 160 bears against the inner surface of the outer sleeve member 141, yet in order to retain the expansion ring 160 inwardly sufficiently to allow the outer sleeve member 141 to be made up in the axial position as illustrated in FIG. 9 where the threads 153 are axially below the threads 150 of the mandrel, dowels 161 are provided in holes about the upper extension 191 extending from the upper box 143. Dowels 161 are placed radially between the inner surface of the upwardly extending wall 193 and the radially outer portion of the head 162 of each "T" shaped pin 159. Thus, the dowels prevent the expansion ring 160 from expanding because the "T" shaped pins 159 are prevented from moving outwardly by dowels 161. As mentioned above, the foot 195 of each pin is secured to the expansion ring 160 by means of retainer rings 196, thereby tying all "T" shaped pins 159 together with ring 160 whereby all the pins 159 and the ring 160 are constrained to move angularly as a unit.

In the connection as illustrated in FIGS. 9 and 10, the outer sleeve member 141 and the mandrel 140 are coupled together whereby the outer sleeve 141 may be made up with its threads 153 shifted axially below the threads 150 of the mandrel member. Of course, once the first connection is made between the left hand threads 153 of the sleeve and the left hand threads 152 of the upper box member 143 of the lower body member 142, the expansion ring is prevented from moving outwardly by the engagement of the expansion ring 160 against the interior surface of the outer sleeve 141.

Returning again to the illustration of FIG. 10, a spring loaded radially extending pin 197 is provided in the mandrel 140 and extends between the heads 162 of two adjacent "T" shaped pins 159. Spring 198 acts to urge pin 197 outwardly. FIG. 9 shows that like the illustration of FIG. 2, test tool 100 is constructed such that the sleeve 141 and mandrel 140 may be axially shifted with respect to one another by the action of slots and splines 175, 176 but the slot and spline construction forces the mandrel 140 and the sleeve 141 to move angularly as a unit when the mandrel 140 is rotated angularly by action of the drill pipe 30.

Thus, as the drill pipe 30 is turned to the right, the threads 153 on the interior surface of the outer sleeve member 141 are unthreaded from the left hand threads 152 of the upper box member 143. As the mandrel 140 is turned, the spring loaded pin 197 is rotated clockwise against the head 162 of pin 159 urging it clockwise. Clockwise urging of a single pin 159 causes all of the pins 159 and the expansion ring to rotate slightly clockwise until the heads of the pins 162 are no longer radially blocked by dowels 161. Once the unthreading of outer sleeve member 141 with respect to the upper box member 143 is complete and the expansion ring 160 is below the bottom most threads of the outer sleeve member 141, the expansion ring 160 moves radially outwardly.

It should be noticed that before the expansion ring 160 is moved radially outwardly, the heads 162 of pins 159 prevent the exterior right hand threads 150 on mandrel 140 from axially shifting downwardly into engagement with interior right hand threads 151 on box member 143. Thus, in the first connection, the mandrel 140 is prevented from being connected to the interior threads 151 while the threads 153 on the outer sleeve member are allowed to be shifted axially downward into engagement with the exterior threads 152 of the upper box member 143. After the outer sleeve has been turned to the right and unthreaded from the threads 152, the expansion ring moves outwardly, the heads 162 of the "T" shaped pins 159 move radially outwardly readying the tool 100 for reconnection of the upper body means comprising sleeve 141 and mandrel 140 to the lower body means 142.

Thus, after testing of the shear blowout preventer and it is desired to reconnect the upper part of the tool 100 to the lower body means 142, the tool is lowered downwardly until engagement with the lower body means 142 occurs.

FIG. 11 shows the condition of the tool after the upper part of the tool has been reconnected to the lower part of the tool. In this condition, the threads 153 on the outer sleeve member are prevented from axially shifting downward by virtue of the radially extending expansion ring 160. The heads 162 of the "T" shaped pins 159 have also been shifted outwardly by virtue of their connection to the expansion ring 160 thereby allowing the threaded surface 150 on the exterior surface of the mandrel 140 to slide past the upper extension 191 and the head 162 of the "T" shaped pins 159 until threaded engagement can occur between the right hand threads 150 on the mandrel and the right hand threads 151 on the interior of the upper box member 143.

FIG. 12 illustrates a cross section through the upper extension 191 of the upper box member 143 and illustrates that the expansion ring 162 and the "T" shaped pins 159 have been moved radially outwardly and further illustrates that the dowels 161 no longer retain the expansion ring 162 and the pins 159 in a radially inward position.

FIG. 11 illustrates that the pin 197 of mandrel 140 has been shifted downwardly along with the mandrel 140 and are not illustrated in FIG. 12 which is a section through lines 12—12 of FIG. 11.

FIGS. 9 and 11 illustrate holes or ports 210 which are provided in the lower body means 142 below the threaded surfaces 152 and 151 of the upper box member 143. In the first connection illustrated in FIG. 9, holes 210 are covered by the downwardly extending outer sleeve member 141. When the tool 100 is put into the condition where the outer sleeve 141 has been shifted upwardly with respect to the mandrel 140, the holes 210 are uncovered thereby providing a drain means by which the test tool 100 and any fluid in the interior of the drill pipe may be drained as the test tool is returned to the surface along with the drill pipe 30. An "O" ring 211 seals the lower body means 142 to the outer sleeve 141 thereby preventing drilling fluid and the like from escaping from the interior of the tool 100 and the axial bore of the drill pipe 30 in the connection of FIG. 9. Likewise, "O" ring 212 seals the upper portion of the outer sleeve 141 to the mandrel 140.

Although the orientation of the second alternative embodiment of the tool 100 is as illustrated in FIG. 9, its operative elements may be inverted, (i.e., turned upside down) and function effectively for disconnecting and reconnecting the wellhead sealing tool to a drill string. When inverted, the body means 142 would be provided with threads to connect with drill pipe 30, and the body means comprising sleeve 141 and mandrel 140 would include means for landing a check valve and means for connecting the wellhead sealing tool. When inverted, the box section 143 extends downwardly and is initially connected via its external threads with the threads of the sleeve 141. On turning the drill pipe to the right the shuttle ring in the box section and the pin 197 in the end of the sleeve 141 function in the same manner as in the non-inverted orientation of FIG. 9. That is, after the body means 142 is turned to the right and raised above the sleeve 141, the expansion ring moves outwardly thereby blocking reconnection with the threads of sleeve 141. On lowering the body means 142 for reconnection, the heads 162 of the "T" shaped pins having been moved radially outward no longer block threaded engagement of the threads on the interior cylindrical surface of box 143 with the threads 150 of the mandrel 140 and right hand turning of the body means 142 reestablishes the connection to mandrel 140 and the attached wellhead sealing tool below.

There is provided according to the invention a test tool especially adapted for use in testing subsea blowout preventer stacks. A sealing tool may be attached to the bottom of the tool for sealing about the wellhead. A check valve may be provided in the lower part of the tool for providing a means for testing the effectiveness of the sealing tool in sealing about the wellhead. Further, there is provided a means for disconnecting the upper body from the lower body initially connected by means of left hand threads. Rotation to the right by the drill pipe and axial force upward by the drill pipe disconnects the upper body means from the lower body means without rotation to the left which could cause disconnection of drill pipe joints.

The upper part of the tool is axially removed from the lower part of the tool allowing the shear ram blowout preventer to be effectively tested. The tool may be reconnected by lowering of the drill pipe which lowers the upper body for engagement with the lower body and a second connection may be established by means of right hand rotation of the drill pipe. The drain ports are aligned and established at the second connection allowing the entire tool including the test sealing tool and check valve to be raised while draining any drilling fluid from the interior of the drill pipe.

Various modifications and alterations in the described apparatus and tool will be apparent to those skilled in the art from the foregoing description which does not depart from the spirit of the invention. The foregoing disclosure and description of the invention are illustrative and explanatory thereof and details of the illustrative embodiment may be made without departing from the spirit of the invention.

What is claimed is:

1. A test tool adapted for use during testing of a subsea blowout preventer stack attached to a wellhead comprising, upper body means having means at its upper end for connection to the end of a drill pipe, the upper body means having an axial bore communicating with the interior of the drill pipe, lower body means having an axial bore therein and having at its lower end means for connecting to a wellhead sealing tool means for sealing between the lower body means and the wellhead, and releasable and reconnectable coupling means for connecting the lower body means to the upper body means in a first connection, the axial bore of the upper body means being in fluid communication with the axial bore of the lower body means, for disconnecting the lower body means from the upper body means by turning the drill pipe in a direction tending to tighten drill pipe joints while axially moving the drill pipe solely in one direction, and for reconnecting the upper body means to the lower body means in a seconnd connection without removing the drill pipe from the well by turning the drill pipe in the same direction.

2. The tool of claim 1 wherein the axial bore of the lower body means has a landing means for landing a check valve means therein.

3. A test tool adapted for use during testing of a subsea blowout preventer stack attached to a wellhead comprising, upper body means having means at its upper end for connection to the end of a drill pipe, the upper body means having an axial bore communicating with the interior of the drill pipe, lower body means having an axial bore therein and having at its lower end means for connecting to a wellhead sealing tool means for sealing between the lower body means and the wellhead, releasable and reconnectable coupling means for connecting the lower body means to the upper body means in a first connection, the axial bore of the upper body means being in fluid communication with the axial bore of the lower body means, for disconnecting the lower body means from the upper body means by turning the drill pipe in a direction tending to tighten drill pipe joints, and for reconnecting the upper body means to the lower body means in a second connection without removing the drill pipe from the well by turning the drill pipe in the same direction, wherein said drill pipe is turned to the right to tighten its joint connection and wherein the coupling means comprises, a box member extending upwardly from the lower body member having female left hand threads provided on its inner surface and male right hand threads provided on its outer surface, a cylindrical mandrel member extending downwardly from the upper body member having male left hand threads provided on its outer surface, an outer sleeve member having female right hand threads provided on its inner surface, the outer sleeve being shiftably secured to said mandrel in a first position such that the female right hand threads on its inner surface are axially above the male left hand threads on the mandrel, whereby turning the drill pipe to the right disconnects the threads of the mandrel member and the box member of the lower body member, and means responsive to upward force on the drill pipe after disconnection of the mandrel member from the box member for axially shifting the mandrel member with respect to the outer sleeve member to a second position such that the female right hand threads on its inner sleeve surface are axially below the male left hand threads on the mandrel, whereby lowering the drill pipe and turning the drill pipe to the right causes the female right hand threads on the interior of the sleeve member to make up with the male right hand threads on the outer surface of the box member thereby reconnecting the upper body means with the lower body means.

4. The tool of claim 3 wherein the outer sleeve is secured in the first position by a retaining ring disposed in a groove about the exterior periphery of the box wall below the male and female threaded portions of the member, the ring extending outwardly from the box wall into a recess about the interior periphery of the outer sleeve, the retaining ring retained outwardly into securing engagement with the outer sleeve recess by a plurality of retaining pins disposed between the retaining ring and a cylindrical outer surface of the mandrel extending below the threads on the mandrel.

5. The tool of claim 4 wherein the axial shifting means comprises, cooperative spline and slot means for allowing relative axial movement between the mandrel and the outer sleeve while preventing relative angular movement between the mandrel and the outer sleeve means, an upwardly facing shoulder on the mandrel member, a downwardly facing shoulder on the outer sleeve member, the mandrel upwardly facing shoulder being axially aligned but separated in the first position from the sleeve downwardly facing shoulder by a first predetermined distance, a plurality of spring-loaded locking pins disposed about the periphery of the mandrel member in outwardly facing holes in the mandrel, the holes being spaced a second predetermined distance beneath the upwardly facing shoulder on the mandrel member, a plurality of inwardly facing recesses disposed about the periphery of the outer sleeve member, the recesses being angularly aligned with the locking pins in the holes in the mandrel member but spaced the second predetermined distance beneath the downwardly facing shoulder, the locking pins in the holes of the mandrel member in the first position being downwardly spaced from the recesses in the outer sleeve member by the first predetermined distance, whereby turning the drill pipe to the right disconnects the threaded connection between the mandrel member from the box member and further upward force of the drill pipe causes the mandrel member to move axially upward a distance equal to the first predetermined distance relative to the outer sleeve member until the upwardly facing shoulder on the mandrel member abuts the downwardly facing shoulder on the sleeve member and the locking pins move outwardly from the holes in the mandrel member into the recesses in the sleeve member whereby the sleeve is axially locked to the mandrel in the second position.

6. The tool of claim 3 further comprising a first plurality of holes angularly spaced about the periphery of the box member below the upwardly extending inwardly and outwardly threaded portion thereof, a second plurality of holes angularly spaced about the periphery of the outer sleeve member, the holes in the outer sleeve being axially spaced above the holes of the box member when the outer sleeve is secured to the mandrel in the first position, sealing means for sealing the end of the mandrel to an interior bored surface of the box member when the tool is in the first connection, whereby fluid communication from the axial bore of the tool to the first plurality of holes in the box member is prevented in the first connection, and whereby when the sleeve member has been shifted to its second position and the tool has been reconnected in its second connection, the holes of the outer sleeve are aligned axially with the holes of the box member allowing fluid communication between the interior of the tool and the exterior of the tool thereby allowing the interior of the tool and the attached drill pipe to drain during raising of the tool from the wall.

7. A test tool adapted for use during testing of a subsea blowout preventer stack attached to a wellhead comprising, upper body means having means at its upper end for connection to the end of a drill pipe, the upper body means having an axial bore communicating with the interior of the drill pipe, lower body means having an axial bore therein and having at its lower end means for connecting to a wellhead sealing tool means for sealing between the lower body means and the wellhead, releasable and reconnectable coupling means for connecting the lower body means to the upper body means in a first connection, the axial bore of the upper body means being in fluid communication with the axial bore of the lower body means, for disconnecting the lower body means from the upper body means by turning the drill pipe in a direction tending to tighten drill pipe joints, and for reconnecting the upper body means to the lower body means in a second connection without removing the drill pipe from the well by turning the drill pipe in the same direction, and means for closing drain ports to the interior bore of the tool when the lower body means is connected to the upper body means in the first connection and for opening the drain ports to the interior bore of the tool when the lower body means is reconnected to the upper body means in the second connection.

8. Apparatus for disconnecting and reconnecting two parts of a tool in a well comprising, upper body means having connection means at its top end for connection to a drill pipe and having first and second threaded surfaces axially separated from each other at its lower end, the first threaded surface having left hand threads, the second threaded surface having right hand threads, shifting means for axially shifting the threaded surfaces of the upper body means from a first position where the first threaded surface is axially below the second threaded surface to a second position where the second threaded surface is axially below the first threaded surface, lower body means having third and fourth threaded surfaces, the third threaded surface having left hand threads, the fourth threaded surface having right hand threads, and whereby in a first connection the upper and lower body means are connected by left hand threading of the first threaded surface of the upper body means with the third threaded surface of the lower body means, whereby the first connection is disconnected by rotating the upper body means to the right with respect to the lower body means, and after disconnecting of the upper body means from the lower body means and shifting of the first and second threaded surfaces of the upper body means from the first position to the second position by the shifting means, a reconnection between the upper and lower body member is established by engaging the upper and lower body members and turning the upper body member to the right with respect to the lower body member causing the second threaded surface of the upper body member to threadedly connect with the fourth threaded surface of the lower body member.

9. The apparatus of claim 8 wherein the upper and lower body means have axial bores for fluid communication therethrough and for fluid communication with the interior of a drill pipe when connected to the upper body means.

10. The apparatus of claim 9 further comprising means for connecting a wellhead sealing means to the bottom of the lower body means, the wellhead sealing means being adapted to seal the annulus between a wellhead and the lower body means and having a bore therethrough for fluid communication with the bore of the lower body means.

11. The apparatus of claim 10 wherein the bore of the lower body means has a landing means for landing a check valve adapted to prevent fluid flow from the lower body means through the valve but to allow fluid flow from the bore of the connected wellhead sealing means to the lower body means.

12. The apparatus of claim 11 further comprising means for closing drain ports to the bore of the apparatus when the upper body means and lower body means are in the first connection and for opening the drain ports to the bore of the apparatus when the upper body means and lower body means are in the second connection.

13. The apparatus of claim 12 wherein, the lower body means has an upwardly extending box member and wherein the third threaded surface is an external cylindrical surface having left hand threads provided thereon and wherein the fourth threaded surface is an internal cylindrical surface having right hand threads provided thereon, the upper body means has a mandrel member axially shiftable within an outer sleeve member, and wherein the first threaded surface is an internal cylindrical surface within the outer sleeve member having left hand threads provided thereon, and wherein the second threaded surface is an external cylindrical surface on the mandrel member having right hand threads provided thereon, and wherein the drain ports are a plurality of holes in the lower body means which are axially disposed below the third and fourth threaded surfaces, and wherein in the first connection, the drain ports are covered by the interior surface of the outer sleeve member, and after relative axial shifting of the outer sleeve member with respect to the mandrel member and the upper and lower body means are reconnected in the second connection, the ports are uncovered.

14. The apparatus of claim 8 wherein the lower body means has an upwardly extending box member and wherein the third threaded surface is an internal cylindrical surface having left hand threads provided thereon and wherein the fourth threaded surface is an external cylindrical surface having right hand threads provided thereon, the upper body means has a mandrel member axially shiftable within an outer sleeve member, and wherein the first threaded surface is an external cylindrical surface on the mandrel having left hand threads provided thereon, and wherein the second threaded surface is an internal cylindrical surface within the outer sleeve member having right hand threads provided thereon.

15. The apparatus of claim 13 wherein the outer sleeve is secured in the first position by a retaining ring disposed in a groove about the exterior periphery of the box wall below the male and female threaded portions of the member, the ring extending outwardly from the box wall into a recess about the interior periphery of the outer sleeve, the retaining ring retained outwardly into securing engagement with the outer sleeve recess by a plurality of retaining pins disposed between the retaining ring and a cylindrical outer surface of the mandrel extending below the threads on the mandrel.

16. The apparatus of claim 15 wherein the axial shifting means comprises, cooperative spline and slot means for allowing relative axial movement between the mandrel and the outer sleeve while preventing relative angular movement between the mandrel and the outer sleeve means, an upwardly facing shoulder on the mandrel member, a downwardly facing shoulder on the outer sleeve member, the mandrel upwardly facing shoulder being axially aligned but separated in the first position from the sleeve downwardly facing shoulder by a first predetermined distance, a plurality of spring-loaded locking pins disposed about the periphery of the mandrel member in outwardly facing holes in the mandrel, the holes being spaced a second predetermined distance beneath the upwardly facing shoulder on the mandrel member, a plurality of inwardly facing recesses disposed about the periphery of the outer sleeve member, the recesses being angularly aligned with the locking pins in the holes in the mandrel member but spaced the second predetermined distance beneath the downwardly facing shoulder, the locking pins in the holes of the mandrel member in the first position being downwardly spaced from the recesses in the outer sleeve member by the first predetermined distance, whereby turning the drill pipe to the right disconnects the threaded connection between the mandrel member from the box member and further upward force of the drill pipe causes the mandrel member to move axially upward a distance equal to the first predetermined distance relative to the outer sleeve member until the upwardly facing shoulder on the mandrel member abuts the downwardly facing shoulder on the sleeve member and the locking pins move outwardly from the holes in the mandrel member into the recesses in the sleeve member whereby the sleeve is axially locked to the mandrel in the second position.

17. The apparatus of claim 8 wherein the lower body means has an upwardly extending box member and wherein the third threaded surface is an external cylindrical surface having left hand threads provided thereon and wherein the fourth threaded surface is an internal cylindrical surface having right hand threads provided thereon, the upper body means has a mandrel member axially shiftable within an outer sleeve member, and wherein the first threaded surface is an internal cylindrical surface within the outer sleeve member having left hand threads provided thereon, and wherein the second threaded surface is an external cylindrical surface on the mandrel having right hand threads provided thereon.

18. The apparatus of claim 17 wherein in the first connection the left hand threads of the outer sleeve member of the upper body means are threadedly engaged with the external threads on the box member of the lower body means, and wherein the shifting means comprises shuttle ring means for preventing the right hand threads on the external cylindrical surface of the mandrel member from axially shifting downwardly into engagement with the right hand threads on the internal cylindrical surface of the box member while the tool is in the first connection and after the upper body means is turned to the right with respect to the lower body means and the first connection is disconnected for preventing the left hand threads of the outer sleeve from axially shifting downwardly while allowing the external right hand threads on the exterior surface of the mandrel to shift downwardly for connection to the internal right hand threads on the upper box member of the lower body means.

19. The apparatus of claim 17 wherein the shifting means comprises cooperative spline and slot means for allowing relative axial movement between the mandrel member and the outer sleeve member while preventing relative angular movement between the mandrel and the outer sleeve member, shuttle ring means having an expansion ring disposed in the first connection between the interior cylindrical surface of the outer sleeve member and an outer wall of a slotted upper extension of the upwardly extending box member, the extension disposed upwardly from the third and fourth threaded surfaces provided on the exterior and interior walls of the upper box member, a plurality of "T" shaped pins provided in slots disposed about the wall of the upper extension of the upwardly extending box member, the columns of the "T" shaped pins extending through the slots in the upper extension of the box member, the feet of the "T" shaped pins secured to the expansion ring, the heads of the "T" shaped pins disposed between the inner wall of the slotted upper extension of the box and an outer wall of the mandrel member, retaining means disposed between the heads of the "T" shaped pins and the inner wall of the slotted annular extension of the upwardly extending box member for preventing the expansion ring from expanding outwardly while the mandrel member and the outer sleeve member are initially made up, at least one spring loaded pin means extending outwardly from the wall of the mandrel member between the heads of two "T" shaped pins, and whereby after the outer sleeve member is connected to the box member of the lower body means in the first connection and during the turning of the upper body means to the right thereby unthreading the outer sleeve member from the lower body means, the spring loaded pin extending from the mandrel member wall engages one of the heads of the "T" shaped pins urging it and all the "T" shaped pins past the retaining means thereby allowing the expansion ring to expand outwardly once the outer sleeve member has been unthreaded from the box member of the lower body means, the outwardly extending expansion ring thereafter preventing axial shifting of the outer sleeve member past the expansion ring on the upper box member, the heads of the "T" shaped pins being urged radially outwardly by the expansion ring to a position against the inner wall of the upper extension thereby providing clearance for the external threads of the mandrel member to move axially past the upper extension and threadedly engage the interior threads of the box member of the lower body means to effect the second connection between the lower body means and the upper body means.

20. The apparatus of claim 19 wherein the retaining means are a plurality of dowels disposed in holes of the upper extension of the box member, the holes spaced angularly about the circumference of the upper extension, the holes disposed radially inwardly adjacent the inner wall of the upper extension of the box member, whereby on initial make up of the mandrel member and the outer sleeve member, the dowels are disposed between the heads of the "T" shaped pins and the inner wall of the upper extension member and allow the outer sleeve member to axially shift downwardly past the expansion ring for establishing the first connection between the upper body means and the lower body means.

21. Apparatus for disconnecting and reconnecting two parts of a tool in a well comprising, upper body means having connection means at its top end for connection to a drill pipe and having third and fourth threaded surfaces, the third threaded surface having left hand threads, the fourth threaded surface having right hand threads, lower body means having first and second threaded surfaces axially separated from each other at its lower end, the first threaded surface having left hand threads, the second threaded surface having right hand threads, shifting means for axially shifting the threaded surfaces of the lower body means from a first position where the first threaded surface is axially above the second threaded surface to a second position where the second threaded surface is axially above the first threaded surface, whereby in a first connection the upper and lower body means are connected by left hand threading of the third threaded surface of the upper body means with the first threaded surface of the lower body means, whereby the first connection is disconnected by rotating the upper body means to the right with respect to the lower body means, and after disconnecting of the upper body means from the lower body means and shifting of the third and fourth threaded surfaces of the upper body means from the first position to the second position by the shifting means, a reconnection between the upper and lower body member is established by engaging the upper and lower body members and turning the upper body member to the right with respect to the lower body member causing the fourth threaded surface of the upper body member to threadedly connect with the second threaded surface of the lower body member.

22. The apparatus of claim 21 wherein the upper body means has a downwardly extending box member and wherein the third threaded surface is an external cylindrical surface having left hand threads provided thereon and wherein the fourth threaded surface is an internal cylindrical surface having right hand threads provided thereon, the lower body means has a mandrel member axially shiftable within an outer sleeve member, and wherein the first threaded surface is an internal cylindrical surface within the outer sleeve member having left hand threads provided thereon, and wherein the second threaded surface is an external cylindrical surface on the mandrel having right hand threads provided thereon.

23. The apparatus of claim 22 wherein in the first connection the left hand threads of the outer sleeve member of the lower body means are threadedly engaged with the external threads on the box member of the upper body means, and wherein the shifting means comprises shuttle ring means for preventing the right hand threads on the internal cylindrical surface of the box member from axially shifting downwardly into engagement with the right hand threads on the external cylindrical surface of the mandrel member while the tool is in the first connection and after the upper body means is turned to the right with respect to the lower body means and the first connection is disconnected for preventing the left hand threads of the box member from axially shifting downwardly while allowing the external right hand threads on the exterior surface of the mandrel to connect with the internal right hand threads on the box member of the upper body means.

24. The apparatus of claim 22 wherein the shifting means comprises cooperative spline and slot means for allowing relative axial movement between the mandrel member and the outer sleeve member while preventing relative angular movement between the mandrel and the outer sleeve member, shuttle ring means having an expansion ring disposed in the first connection between the interior cylindrical surface of the outer sleeve member and an outer wall of a slotted lower extension of the downwardly extending box member, the extension disposed downwardly from the third and fourth threaded surfaces provided on the exterior and interior walls of the lower box member, a plurality of "T" shaped pins provided in slots disposed about the wall of the lower extension of the downwardly extending box member, the columns of the "T" shaped pins extending through the slots in the lower extension of the box member, the feet of the "T" shaped pins secured to the expansion ring, the heads of the "T" shaped pins disposed between the inner wall of the slotted lower extension of the box and an outer wall of the mandrel member, retaining means disposed between the heads of the "T" shaped pins and the inner wall of the slotted annular extension of the downwardly extending box member for preventing the expansion ring from expanding outwardly while the mandrel member and the outer sleeve member are initially made up, at least one spring loaded pin means extending outwardly from the wall of the mandrel member between the heads of two "T" shaped pins, and whereby after the outer sleeve member is connected to the box member of the upper body means in the first connection and during the turning of the upper body means to the right thereby unthreading the outer sleeve member from the upper body means, the spring loaded pin extending from the mandrel member wall engages one of the heads of the "T" shaped pins urging it and all the "T" shaped pins past the retaining means thereby allowing the expansion ring to expand outwardly once the outer sleeve member has been unthreaded from the box member of the upper body means, the outwardly extending expansion ring thereafter preventing axial shifting of the outer sleeve member past the expansion ring on the upper box member, the heads of the "T" shaped pins being urged radially outwardly by the expansion ring to a position against the inner wall of the lower extension thereby providing clearance for the external threads of the mandrel member to move axially past the lower extension and threadedly engage the interior threads of the box member of the upper body means to effect the second connection between the upper body means and the lower body means.

25. The apparatus of claim 24 wherein the retaining means are a plurality of dowels disposed in holes of the lower extension of the box member, the holes spaced angularly about the circumference of the lower extension, the holes disposed radially inwardly adjacent the inner wall of the lower extension of the box member, whereby on initial make up of the mandrel member and the outer sleeve member, the dowels are disposed between the heads of the "T" shaped pins and the inner wall of the lower extension member and allow the outer sleeve member to axially shift downwardly past the expansion ring for establishing the first connection between the lower body means and the upper body means.

26. The apparatus of claim 21 wherein the upper and lower body means have axial bores for fluid communication therethrough and for fluid communication with the interior of a drill pipe when connected to the upper body means and further comprising means for closing drain ports to the bore of the apparatus when the upper body means and lower body means are in the first connection and for opening the drain ports to the bore of the apparatus when the upper body means and lower body means are in the second connection.

* * * * *